United States Patent [19]

Schröter

[11] 3,949,653

[45] Apr. 13, 1976

[54] APPARATUS FOR BREAKING OUT SCRAP PIECES FROM DIE-CUT OR PUNCHED SHEETS

[76] Inventor: Friedrich Schröter, Am Waldchen 8, 3004 Isernhagen NB-Sud, Germany

[22] Filed: Apr. 10, 1974

[21] Appl. No.: 459,701

[52] U.S. Cl. ..... 93/36 A; 83/103; 83/337; 225/93; 225/103

[51] Int. Cl.[2] ..... B26F 3/02

[58] Field of Search ..... 225/93, 97, 99, 103; 93/36 A; 83/103, 337, 338

[56] References Cited

UNITED STATES PATENTS

| | | | |
|---|---|---|---|
| 2,083,370 | 6/1937 | Greulich | 83/337 |
| 2,445,174 | 7/1948 | Hannewald et al. | 83/337 |
| 3,055,275 | 9/1962 | Schröter | 93/36 A |
| 3,111,055 | 11/1963 | Lubeley | 83/337 |
| 3,784,070 | 1/1974 | Vossen | 225/97 X |

*Primary Examiner*—J. M. Meister
*Assistant Examiner*—Fred A. Silverberg

[57] ABSTRACT

An apparatus for breaking out, stripping or separating scrap pieces from a continuously moving sheet of material such as paper or cardboard having a die-cut or punched pattern therein is disclosed. The apparatus includes a pair of counter-rotating cylinder elements between which the sheet moves. At least one of such cylindrical elements, and preferably both, carry tool assemblies which are cam actuated and guided to cause the tool assemblies to move radially of the cylinders and grippingly engage or grasp even small scrap pieces. The tool assemblies further move such pieces, while firmly gripped, in a direction, usually downwardly, causing separation from the remainder of the sheet of material. The cylindrical elements and tool assemblies are formed for selective adjustment of the location of the tool assemblies over the width of the sheet and around the periphery of the cylinders.

4 Claims, 4 Drawing Figures

APPARATUS FOR BREAKING OUT SCRAP PIECES FROM DIE-CUT OR PUNCHED SHEETS

The invention relates to apparatus for the separation, stripping or breaking out of scrap material which is inherently produced in the punching or die cutting of sheets or webs of material, such as pasteboard, cardboard or similar materials, and more particularly, to the use of paired counter rotating cylinders, between which the pieces of scrap material are seized from both sides and separated from the end product.

Such devices serve to remove from the sheet or web of work material the waste material or scrap, produced during the process of stamping out products from the web, such as folding boxes or similar articles of varying sizes and forms. These pieces of waste material or scrap are generally attached to the product by means of a few threads and strips of the work material which remain at the locations of punching by the punching knife. Consequently, a force must be exerted on the scrap pieces to effect their separation and removal.

The expression "breaking out" is employed herein and in the attached claims to mean the separation, removal, stripping or elimination of the pieces of waste material, also termed scrap pieces, from the work material used in the process.

Needling out of the scrap pieces has, heretofore, generally been employed in a rotational breaking out process. (German Pat. DT-AS No. 1,511,048 and many others). The use of sub-atmospheric pressure to separate and retain the pieces of scrap and effect their removal from the plane of the work material has also been previously proposed (German Pat. DT-AS No. 1,144,576). A further prior device has also been devised wherein an upper cylinder is provided longitudinally with compressible breaking out projections, and an opposed lower cylinder, which lies in a plane which is perpendicular to the plane of advancement of the pieces of working material, is formed so that the pieces of scrap to be broken out come into contact with successive break out projections arranged in position of transferrance in the circumferential direction of the upper cylinder (German Pat. OS No. 1,611,617).

All of these devices accomplish their intended purposes as long as the pieces of scrap are large enough to enable the intended operation upon them to be carried out. The devices disclosed heretofore fail to function properly, however, when the scrap pieces are relatively small, for example, when they are formed as flat circular pieces of about 5 millimeters in diameter or as strips of about 4 millimeters in width.

Needling out of scrap leads to interruptions in the breaking out operation when the individual pieces of the scrap are so small that insertion of the needles results in a rupture or bursting of the work material. These small scrap pieces can no longer be seized and removed with any degree of certainty by a needling out process. A partial vacuum (a complete vacuum never being attained) exerts far too small a force upon relatively small pieces of scrap to assure an interruption-free removal of the scrap. Both of these types of operation are, furthermore, not readily suitable for breaking out larger pieces of scrap of relatively high flexible rigidity, as, for example, those obtained from relatively heavy cardobard, corrugated cardboard, or the like. German Pat. DT-OS No. 1,611,617 is specifically directed to such a device. It does not, however, enable efficient holding of the scrap at the beginning of the breaking out operation and consequently does not provide for uninterrupted removal of small pieces of scrap.

The efficient removal of small or long and thin pieces of scrap is of the greatest practical importance, however, since the production of this type of scrap in relatively great abundance is encountered in punching out of folding boxes and the like. The practicality of the entire punching operation is, therefore, dependent upon the efficient separation and removal of small and thin scrap pieces.

These problems are resolved by the present invention in accordance with which at least one of two counter-rotating cylindrical elements is provided with radially movable breaking out tool assemblies which are actuated by cams during rotation of the cylindrical elements. The present devices afford a great degree of freedom with respect to the timing of tool operation during the course of the breaking out operation. The pieces of scrap are securely grasped or gripped by the tool assemblies from the very beginning of the breaking out step to their release, so that there is no opportunity for failure of removal of even the smallest piece of scrap.

In the practical application of the invention it is of advantage to have at least those cylindrical elements which carry the radially movable breaking out tools, which are cam actuated upon rotation of the cylinders, rotatably mounted to a fixed shaft. The shaft remains stationary in the machine and the tool actuating cams are mounted to the fixed shaft. Each rotating cylinder is formed by side discs which are bearing mounted on the shaft and have a support extending therebetween to which ring guides may be mounted. Removable, bow-formed ring guides are provided, which are adjustably mounted for movement along the length of the support member connecting the side discs. The ring guides have breaking out tools mounted thereon, which are adjustable in a circumferential or peripheral direction.

This embodiment provides for the adjustment, or setting, of the breaking out tools in accordance with the different forms and arrangement of the scrap pieces.

The upper and lower breaking out tools are suitably provided with radially acting compression springs in order to securely clamp scrap pieces of varying thicknesses.

In a preferred embodiment of the invention at least those cylindrical elements which are equipped with breaking out tools, have bow-formed ring segments which are adjustable in the direction of the cylinder shaft attached to the supports.

These ring segments can be provided with an elastic coating on their peripheral surfaces, and they will serve to advance the working materials remaining in the plane of material flow and insure its uniform flow during the breaking out operation.

It is advantageous to provide the lower cylinder with tangential rods adjustable along the length of the cylinder shaft. These rods advance the sheet or cutting of web material tangentially toward the lower roller and support the work material remaining in the plane of material flow during the breaking out operation.

In one important embodiment of the invention the supports positioned between the rotatably and bearing mounted side discs, in the breaking out installation of the punching machine and in a similar separate installation assembly, are provided with corresponding or coinciding scale measure or position indications. The bow-formed ring guides with the attached radially oriented breaking out tools can be speedily mounted in precise position in the breaking out apparatus of the punching machine.

By means of the invention the following advantages are obtained:

Scrap pieces of all sizes, especially those of the smallest size are broken out uniformly and without interruption by means of a rotating breaking out device having a minimal size and capable of high material throughput rates. The apparatus does not require stopping of the flow of sheet or web material to effect the breaking out operation. The breaking out tools are broadly applicable to a wide variety of support installations. The device is adaptable to the manufacture of parts having a wide variation in the form and arrangement of the scrap pieces. The tool assembly can be assembled separately of the overall apparatus and installed in the break out apparatus in a minimum of time.

There is described hereinafter an example of an embodiment of the present invention with reference to the attached drawings, wherein.

Figure 1:
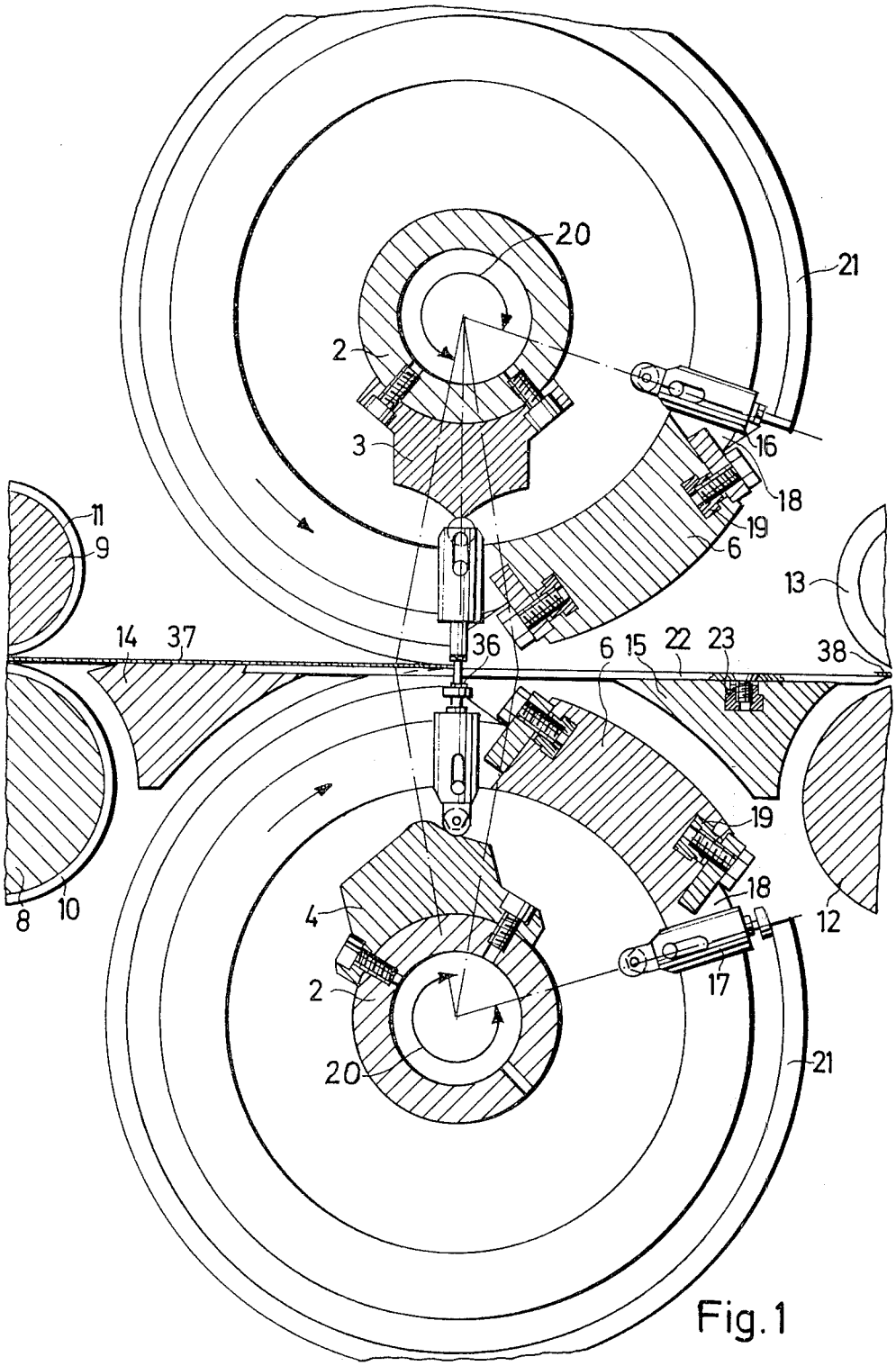
FIG. 1 illustrates a side elevational view, in section along the direction of material flow, of an apparatus constructed in accordance with the present invention.

The apparatus consists of frame 1, shafts 2 fixedly mounted to frame 1 with cams 3 and 4 fastened or screwed to shafts 2. Rotatably mounted to shafts 2 upon bearings are cylindrical elements comprised of side discs 5, between which supports 6 extend and are fastened. Side discs 5 are provided with suitable gearing such as crown or rim gears 7, which engage one another and are driven from both sides of the frame by means of two gear wheels of the punch machine (not shown).

Preceding the assembly, in the plane of material flow, there are positioned two cylinders 8 and 9 which are bearing supported to frame 1, which with the aid of impelling bands 10 and 11 advance the stamped sheets of material 37 or web material cuttings through the apparatus. Following the assembly there is positioned a cylinder 12 with a compression roller 13 to effect the further transport of the scrap-free article. Two supports 14 and 15 are fastened to frame 1 and extend generally parallel to shafts 2.

All of the parts referred to above remain in the machine during a change or replacement of the tool assemblies. The parts which now follow constitute the tool which are exchanged or newly installed when a change in the pattern of scrap material to be separated is effected. Here, upper tool assemblies 16 and lower tool assemblies 17, the construction and function of which are described further on, are of prime importance. The tools are clamped fast in circumferentially or peripherally adjustable positions on the curved or circular guides 18. These guides form a removable part of the cylindrical elements and have a central opening of a diameter which is slightly greater than the diameter of shaft 2 plus the height of cams 3 and 4, so that the curved ring guide 18 can be rotated about and can be mounted and demounted around shafts 2 and cams 3 and 4, when the median line of supports 6 are oriented at about the median lines of cams 3 and 4.

Figure 2:
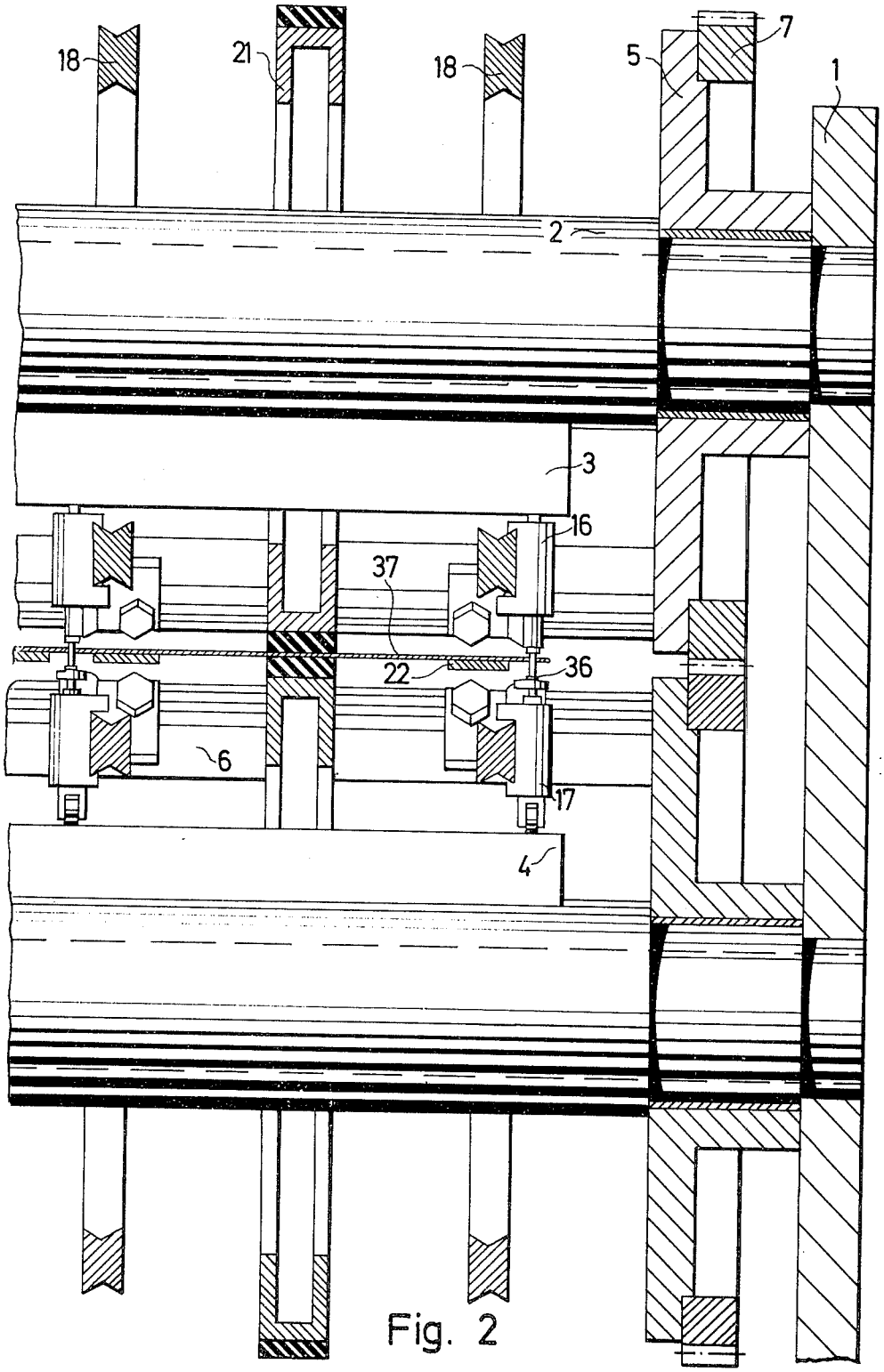
FIG. 2 is a front elevational view, in partial section, of the apparatus of FIG. 1.

As best may be seen in FIG. 2, supports 6 extend along shafts 2 between rotatably mounted discs 5 (only the right disc 5 is shown in FIG. 2). Ring guides 18 are in turn mounted to supports 6 at pre-selected positions between discs 5 for rotation of the ring guides with discs 5 and supports 6. The circumferential openings in the curved ring guides 18 correspond to the circumferential length of the supports 6, which are provided with T-shaped grooves in which suitable elements such as a nut or keys 19 can be shifted to move and clamp fast the curved ring guides 18. Stops on supports 6 assure the precise location of the center of ring guides 18 on the centers of shafts 2.

A breaking out tool assembly can be secured to ring guide 18 at any point within the angle indicated by arrows 20 in FIG. 1, and the ring guides 18 can be adjusted axially over the length of supports 6.

In the same manner as the curved ring guides 18, the curved ring segments 21 can be mounted or demounted and clamped fast on supports 6, and can be provided with a flexible coating to grip the sheet of material and advance the same through the apparatus.

Rods 22 carried by supports 14 and 15 are also interchangeable and adjustable with respect to the breadth of the apparatus; they are clamped fast with the aid of nuts or keys 23 which can be shifted within a T-shaped groove of support 15.

Figure 3:
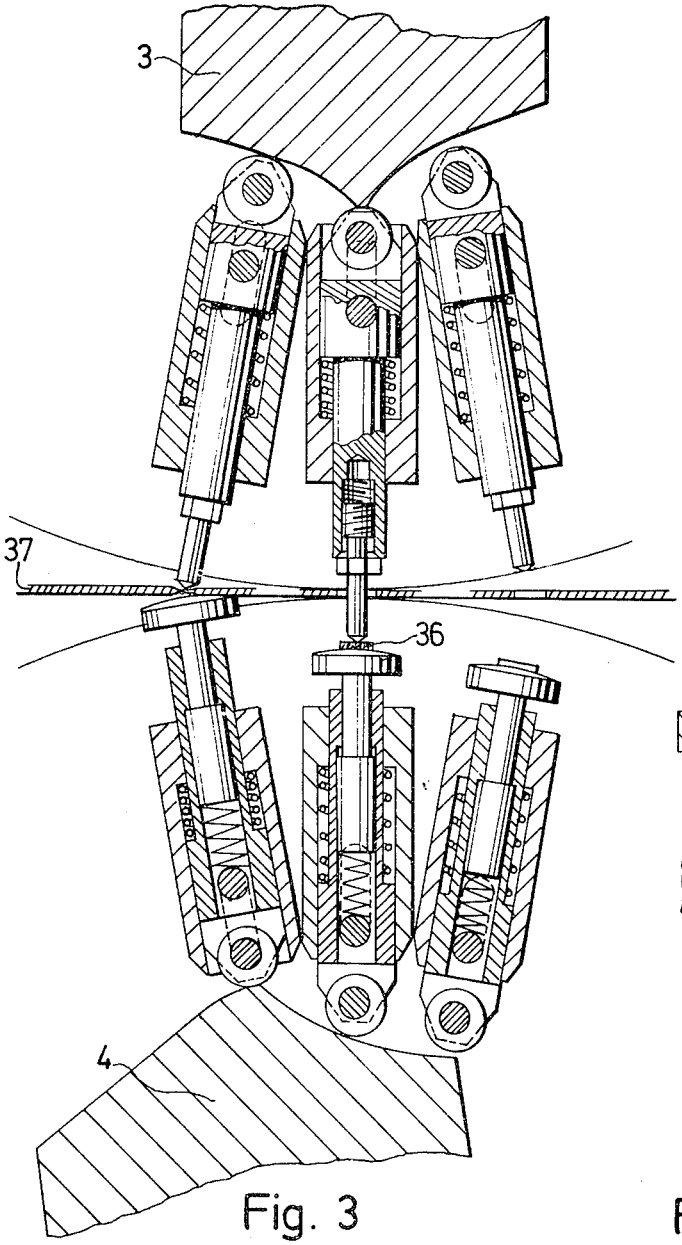
FIG. 3 is an enlarged, fragmentary cross-sectional view of break out tools constructed in accordance with the present invention and illustrating three successive positions of the breaking out tool operation.
Figure 4:
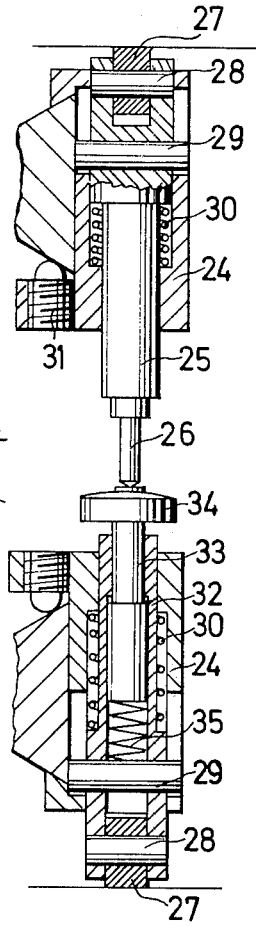
FIG. 4 is an end elevational view in vertical section of the tools of FIG. 3 in the middle position.

The upper tools 16, as shown in FIGS. 3 and 4, consist of a housing 24, a ram 25, guided therein, which has a pressue element 26 replaceably attached thereto, a roller 27 with shaft 28, a pin 29, which prevents a turning of ram 25, and a compression spring 30, which presses ram 25 radially inwardly or upwardly toward pin 29. Spring 30 biases ram 25 upwardly for as long as cam 3 does not engage roller 27 and thereby move ram 25 downwardly or outwardly. Housing 24 is clamped fast on the ring guide 18 at a pre-selected angular position thereon by means of screw 31.

The lower tools 17 are constructed in like manner as the upper ones, namely, housing 24 is provided with a modified ram 32, roller 27 with shaft 28 and pin 29. In place of replaceable pressure element 26, however, a guide pin 33 is provided with a plate 34 carried thereby, which can be compressed radially and inwardly independently of the positioning of ram 32. Compression spring 35 biases pin 33 and plate 34 away from pin 29.

In FIG. 3 the mode of operation of the breaking out tool is shown in three positions. At the beginning of the breaking out operation shown in the left-hand position of FIG. 3, the upper and lower tools, guided or actuated by cams 3 and 4 contact the piece of scrap 36 with pressure elements 26 and plate 34. In the course of further rotation the scrap piece 36, because of the yielding of compression spring 35 is clamped and, as a result of the combined movement of the upper and lower movable tool elements, is moved down out of the plane of the work material until the middle position of the tools is reached, as shown in FIG. 3. During further rotation, the lower movable tool elements 17 maintain their position, whereas the upper movable tool elements return to the position they held at the beginning of the breaking operation, which is the position attained as shown in the right-hand illustration of FIG. 3. The piece of scrap 36 is thereupon freed and falls away upon further rotation.

The installation described presents but a single embodiment of the invention. Also included within the scope of the invention is the formation of only one of the two cylinders with radially movable breaking out tools, which are cam-guided through rotation of the cylinders, since a cam-guided movement can fundamentally comply with any law of motion.

I claim:

1. In an apparatus for stripping or breaking out scrap pieces from a continuously moving sheet of material having a pattern previously cut or punched therein, and including a frame, means for continuously advancing said sheet of material through said apparatus, and a first cylindrical element and a second cylindrical element both rotatably mounted to said frame in opposed relation for passage of said sheet of material therebetween, the improvement comprising:

cam means adjustably mounted to said frame for selective positioning in predetermined fixed and stationary positions proximate said first cylindrical element;

at least one break out tool assembly mounted to said first cylindrical element for engagement with and guiding by said cam means upon rotation of said first cylindrical element, said tool assembly being adapted for radial movement of a portion thereof into engagement with a scrap piece of said sheet of material when guided by said cam means during rotation of said first cylindrical element;

cam means adjustably mounted to said frame for selective positioning in predetermined fixed and stationary positions proximate said second cylindrical element; and at least one tool assembly mounted to said second cylindrical element for engagement with and guiding by said cam means mounted proximate said second cylindrical element upon rotation thereof, said tool assembly on said second cylindrical element being adapted to engage a side of said scrap piece opposite the side engaged by said portion of said tool assembly on said first cylindrical element during rotation of said second cylindrical element to cooperatively grip said scrap piece between said portion of said tool assembly on said first cylindrical element and said portion of said tool assembly on said second cylindrical element, both the tool assemblies further being guided by said cam means for gripped movement of said scrap piece by the portions of the tool assemblies in a direction causing separation of said scrap piece from said sheet of material during further rotation of the cylindrical elements.

2. An apparatus as defined in claim 1 wherein, at least one of the cooperative tool assemblies mounted to said first and second cylindrical elements is provided with a spring formed to radially bias said tool assembly toward engagement with said cam means and an independently operable spring formed to radially bias said portion toward said scrap piece independently of movement of said portion as guided by said cam means.

3. In an apparatus for stripping or breaking out scrap pieces from a continuously moving sheet of material having a pattern previously cut or punched therein, and including a frame, means for continuously advancing said sheet of material through said apparatus, and a first cylindrical element and a second cylindrical element both rotatably mounted to said frame in opposed relation for passage of said sheet of material therebetween, the improvement comprising:

said frame including a stationary shaft, cam means mounted to said shaft proximate said first cylindrical element, said first cylindrical element including a pair of side disc elements mounted to said frame for rotation about said shaft, a support member interconnecting said side disc elements, and at least one ring guide demountably secured to said support member, said support member and ring guide being formed for selective securement of said ring guide at predetermined positions over the length of said support member, at least one break out tool assembly adjustably mounted to said ring guide for selective positioning around the periphery of said ring guide and for engagement with and guiding by said cam means upon rotation of said first cylindrical element, said tool assembly being adapted for radial movement of a portion thereof into engagement with a scrap piece of said sheet of material when guided by said cam means during rotation of said first cylindrical element, said second cylindrical element being adapted to engage a side of said scrap piece opposite the side engaged by said portion of said tool assembly during rotation of said second cylindrical element to cooperatively grip said scrap piece between said portion of said tool assembly and said second cylindrical element, said tool assembly further being guided by said cam means for gripped movement of said scrap piece by said portion of said tool assembly and said second cylindrical in a direction causing separation of said scrap piece from said sheet of material during further rotation of the cylindrical elements.

4. An apparatus as defined in claim 3 wherein, said support member includes a scale indicator having indicia corresponding to predetermined positions of said ring guide over the length of said support member.

* * * * *